US009573392B2

(12) United States Patent
Biglari et al.

(10) Patent No.: US 9,573,392 B2
(45) Date of Patent: Feb. 21, 2017

(54) INK PRINTING APPARATUS, AND METHOD TO OPERATE AN INK PRINTING APPARATUS

(71) Applicant: Oce Printing Systems GmbH & Co. KG, Poing (DE)

(72) Inventors: Mehrad Biglari, Munich (DE); Robert Heimbach, Munich (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 14/936,892

(22) Filed: Nov. 10, 2015

(65) Prior Publication Data

US 2016/0129698 A1 May 12, 2016

(30) Foreign Application Priority Data

Nov. 11, 2014 (DE) ..... 10 2014 116 428

(51) Int. Cl.

| | |
|---|---|
| ***B41J 11/00*** | (2006.01) |
| ***B41J 29/377*** | (2006.01) |
| *B41J 2/355* | (2006.01) |
| *B41J 2/14* | (2006.01) |

(52) U.S. Cl.

CPC ..... *B41J 11/002* (2013.01); *B41J 11/0085* (2013.01); *B41J 29/377* (2013.01); *B41J 2/14088* (2013.01); *B41J 2/355* (2013.01)

(58) Field of Classification Search

CPC ..... B41J 11/002; B41J 29/377; B41J 11/0085; B41J 2/355; B41J 2/14088

See application file for complete search history.

(56) References Cited

U.S. PATENT DOCUMENTS

| | | | | |
|---|---|---|---|---|
| 5,712,672 A * | 1/1998 | Gooray | ..... | B41J 2/01 219/691 |
| 6,390,618 B1 | 5/2002 | Wotton et al. | | |
| 6,837,635 B1 | 1/2005 | Juan | | |
| 9,004,635 B2 | 4/2015 | Biglari et al. | | |

(Continued)

FOREIGN PATENT DOCUMENTS

| | | |
|---|---|---|
| DE | 102010060489 A1 | 5/2012 |
| EP | 0788882 A2 | 8/1997 |

(Continued)

*Primary Examiner* — Henok Legesse
(74) *Attorney, Agent, or Firm* — Schiff Hardin LLP

(57) ABSTRACT

In a method to operate an ink printing apparatus, and in an ink printing apparatus, a recording medium is directed through a printer. The recording medium is subsequently supplied to a dryer having at least one heating saddle and a drying channel arranged at the heating saddle. In the dryer the recording medium is directed past the heating saddle. A negative pressure is generated in the drying channel via an air exhaust arranged at one end of the drying channel. In the printing operation, in a region of the heating saddle a negative pressure is exerted on the recording medium in a direction of the heating saddle so that the heating saddle is then in contact with the recording medium in order to dry the ink on the recording medium. Upon interruption of the printing operation with braking of the recording medium, the negative pressure in the direction of the heating saddle is deactivated at a beginning of the braking.

11 Claims, 2 Drawing Sheets

(56) References Cited

U.S. PATENT DOCUMENTS

| | | | | |
|---|---|---|---|---|
| 2009/0241365 | A1* | 10/2009 | Taguchi | F26B 13/10 34/389 |
| 2011/0236107 | A1* | 9/2011 | Sugiura | B41J 3/60 400/76 |
| 2013/0235138 | A1 | 9/2013 | Samweber | |
| 2014/0210919 | A1* | 7/2014 | Walker | B41J 11/002 347/102 |

FOREIGN PATENT DOCUMENTS

| | | | |
|---|---|---|---|
| EP | 2505368 | A1 | 10/2012 |
| JP | 2122967 | A | 5/1990 |

* cited by examiner

INK PRINTING APPARATUS, AND METHOD TO OPERATE AN INK PRINTING APPARATUS

BACKGROUND

Ink printing apparatuses can be used for single-color or multicolor printing to a web-shaped printing medium, for example a paper web. The design of such ink printing apparatuses is known; see for example EP 0 788 882 B1. Ink printing apparatuses that, for example, operate according to the Drop-on Demand (DoD) principle have as a printer a print head or multiple print heads with nozzle units comprising ink channels and activators, wherein the activators—controlled by a printer controller—can excite ink droplets in the direction of the printing substrate, which ink droplets are directed onto the printing substrate in order to apply print dots for a print image there. The activators can generate ink droplets thermally (bubble jet) or piezoelectrically.

For example, the ink printing apparatuses may have print bars with respective multiple ink print heads. As viewed in the direction of movement of the recording medium, at least one dryer follows the print bars in order to dry the recording medium that has been printed to with the liquid ink. The heating capacity of the dryer is set such that, during the printing operation during which the recording medium is moved with continuous velocity, the recording medium is dried to such an extent that the moisture introduced with the ink is removed. If the operation of the ink printing apparatus is interrupted during a printing pause for example, then so much heat is stored in the region of the dryer and at transport rollers following the dryer, that a segment of the recording medium that is located in this region dries out more significantly than during printing operation.

In the unprinted state, the recording medium (paper, for example) has a defined basic moisture. Given an interruption of the printing operation, the danger exists that a large portion of this basic moisture is removed from the paper. Since, during a longer pause of the printing operation, the recording medium is significantly dried in the region of the dryer and in the region following the dryer (as viewed in the direction of movement of the recording medium), and in contrast to this retains its moisture in the remaining regions, transition regions arise in which segments of normal moisture and significantly dried segments abut one another. The significantly dried segments of the recording medium are somewhat contracted relative to the segments of normal moisture, whereby there is warping in these transition regions. This warping may form waves.

According to U.S. Pat. No. 6,837,635 B1, given a formation of waves in the recording medium in an inkjet printer it is known to keep the waves outside of the printing area so that the print heads may not be damaged.

According to JP 02122967 A, folds or waves in the recording medium are measured by means of an ultrasonic sensor. The height of the print heads is adjusted depending on the determined height of the recording medium. Here as well it is avoided that the print heads come into contact with the recording medium.

SUMMARY

It is an object to specify a dryer in an ink printing apparatus given which a wave formation in the recording medium is optimally avoided even given printing pauses.

In a method to operate an ink printing apparatus, and in an ink printing apparatus, a recording medium is directed through a printer. The recording medium is subsequently supplied to a dryer having at least one heating saddle and a drying channel arranged at the heating saddle. In the dryer the recording medium is directed past the heating saddle. A negative pressure is generated in the drying channel via an air exhaust arranged at one end of the drying channel. In the printing operation, in a region of the heating saddle a negative pressure is exerted on the recording medium in a direction of the heating saddle so that the heating saddle is then in contact with the recording medium in order to dry the ink on the recording medium. Upon interruption of the printing operation with braking of the recording medium, the negative pressure in the direction of the heating saddle is deactivated at a beginning of the braking.

DESCRIPTION OF EXEMPLARY EMBODIMENTS

Figure 1:
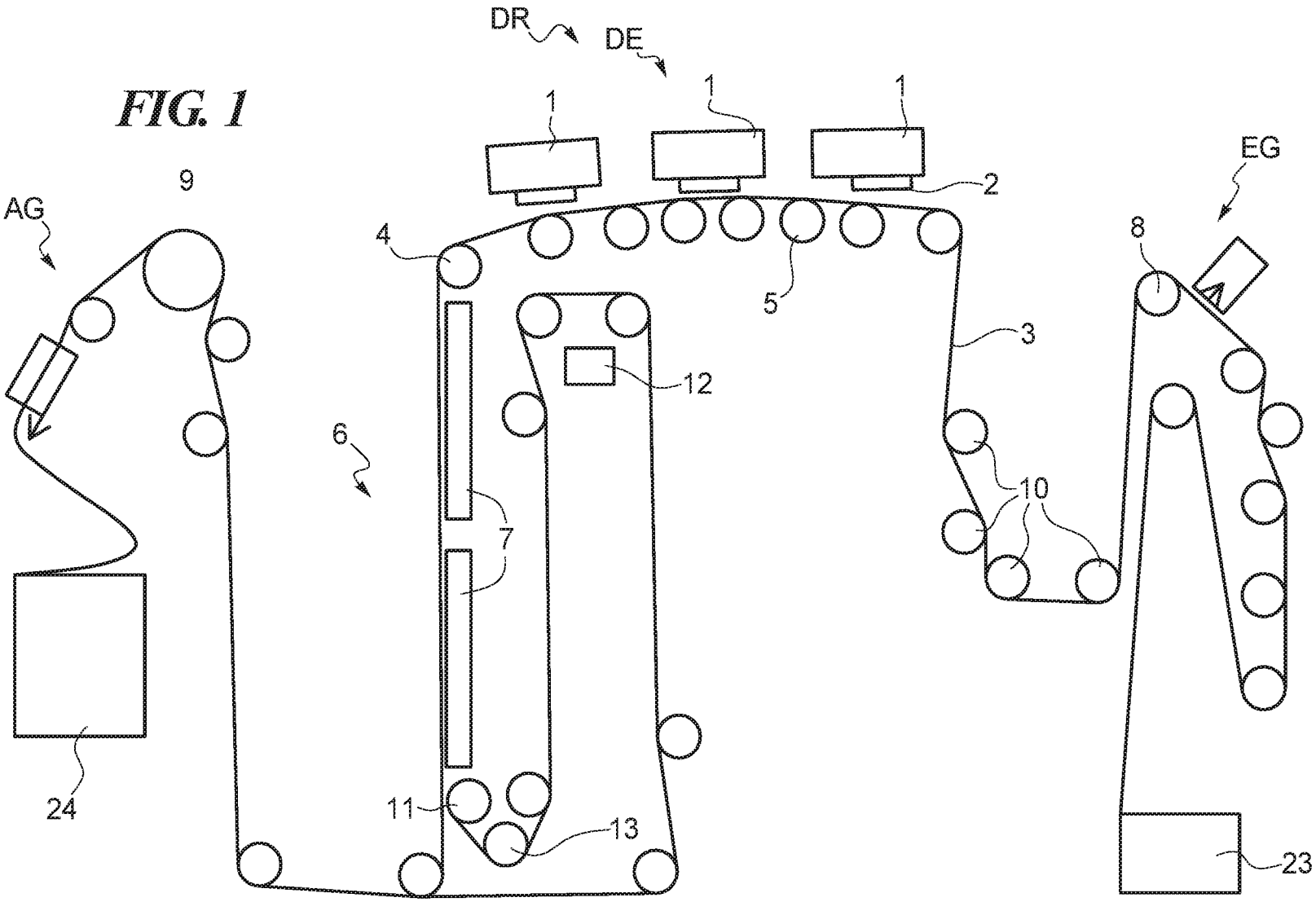
FIG. 1 is a printing apparatus with a transport arrangement to transport a recording medium through the printing apparatus.

For the purposes of promoting an understanding of the principles of the invention, reference will now be made to the preferred exemplary embodiments/best mode illustrated in the drawings and specific language will be used to describe the same. It will nevertheless be understood that no limitation of the scope of the of the invention is thereby intended, and such alterations and further modifications in the illustrated embodiments and such further applications of the principles of the invention as illustrated as would normally occur to one skilled in the art to which the invention relates are included herein.

Given an ink printing apparatus, a printer for printing to a web-shaped recording medium is provided that, for example, may have print bars comprising print heads, and a dryer. The recording medium is transported through the printer via a transport. Arranged at the exit of the printer is a dryer that has at least one heating saddle and a drying channel arranged at the heating saddle, via which drying channel the recording medium is directed past said heating saddle. The dryer has an air exhaust at one end of the drying channel and a negative pressure arrangement that is designed such that it may exert an adjustable negative pressure on the recording medium in the direction of the heating saddle such that this is in direct contact with the recording medium in order to dry the ink on the recording medium. Upon interruption of the printing operation, at the beginning of the stop ramp of the print velocity the negative pressure for the recording medium is deactivated at the dryer and the air exhaust is run up such that the recording medium lifts away from the recording medium and remains in this position until the printing operation is resumed.

The advantage of the exemplary embodiment is in particular that markedly fewer waves may form in the recording medium within the dryer, for example given paper as a recording medium.

An exemplary embodiment is shown in the schematic drawing figures discussed hereafter.

In an ink printing apparatus DR, a transport for the transport of a recording medium 3 from an intake unit EG through a printer DE to a take-up AG is shown in FIG. 1. The printer DE may be designed corresponding to DE 10 2011 000 174 incorporated by reference herein. Arranged along the recording medium 3 is the printer DE, which has one or more print bars 1 with one or more print heads 2 one after another as viewed in the transport direction PF1 of the recording medium 3. For example, given color printing a respective print bar 1 may be provided per color to be printed. With the aid of a take-off roller 4, the recording medium 3 is moved past the print bars 1; it thereby lies on a saddle with guide rollers 5. Provided at the exit of the printer DE is a dryer 6, for example with two heating saddles 7 via which the recording medium 3 that is printed to in the printer DE may be dried.

In addition to the printer DE, the ink printing apparatus DR thus has the intake EG for a recording medium 3 at the intake of the printer unit 1, and the receiver AG for the printed recording medium 3 at the exit of the dryer 6. The transport of the recording medium 3 through the printer DE from the intake EG to the receiver AG is implemented with the aid of the transport for the recording medium 3. Provided for this at the exit of the intake EG is a driven infeed roller 8 that supplies the recording medium 3 to the printer DE. Provided at the exit of the printer DE is a driven take-off roller 13 that supplies the printed recording medium 3 to the receiver AG. The transport arrangement thereby encompasses the transport path of the recording medium 3 from the infeed roller 8 through the printer DE and the dryer 6 to the take-off roller 9 of the receiver AG. The transport path through the printer DE is thereby established with the aid of rollers 10.

FIG. 1 shows the schematic design of such a transport for the processing of the recording medium 3 in stack form (z-folded stacked good). According to FIG. 1, the printing apparatus DR has: the arrangement for transport of a recording medium 3 through the printer DE; a storage container 23 for stacked goods; the intake EG for the recording medium 3 at the intake of the printer DE; and a receiver AG for the printed recording medium 3 at the exit of the printer DE. The recording medium 3 is supplied from the storage container 23 to the intake EG. After the passage through the printer DE, it is directed through the dryer 6 (it therein lies on the heating saddles 6 due to negative pressure) and is thereby dried. From the dryer 6, the recording medium 3 is supplied to the receiver AG. For this, the take-off roller 9 is arranged before the receiver AG so that the printed recording medium 3 may be stored in a stack 24 in the receiver AG.

The dryer 6 has, for example, a heating saddle 7 (FIG. 2) or multiple heating saddles 7 (FIG. 1) along which the recording medium 3 is directed. The respective heating saddle 7 is set to a temperature of approximately 80° C. to 100° C., for example. In the printing operation, in addition to the heating saddle 7 deflection rollers 11 also heat up, which deflection rollers 11 are arranged at the exit of the dryer 7. With the aid of rollers 13, the recording medium 3 may be directed from the exit of the dryer 6 past a cooler 12 and be transported from there to the receiver AG. The design is depicted in more detail in FIG. 2.

Given an interruption of the printing operation—for example during a printing pause—the transport of the recording medium 3 is braked to a standstill in a stop ramp of the printing velocity. If the interruption then lasts longer—for example longer than one to three minutes—this leads to the situation that the recording medium 3 is significantly heated (in particular if the recording medium 3 is comprised of paper) in the region of the dryer 6 and at the deflection rollers 11 heated during the printing operation, such that the recording medium 3 loses the basic moisture with which it is supplied to the take-off roller 4. Such a significantly dried recording medium 3 shrinks. This shrinking generates warping, primarily in the region that adjoins a region with normal moisture of the recording medium 3. The warping leads to the development of waves in the recording medium 3, which waves result from the transition region between a dry segment and a segment of the recording medium 3 having normal moisture.

Given ink printing apparatuses with two printers DE, this may lead to the situation that—after a longer interruption of the printing operation—a segment of the recording medium 3 that has waves is conveyed into the second printer DE. These waves rub against the print heads 2 and may clog or destroy the nozzles of the print heads 2.

Figure 2:
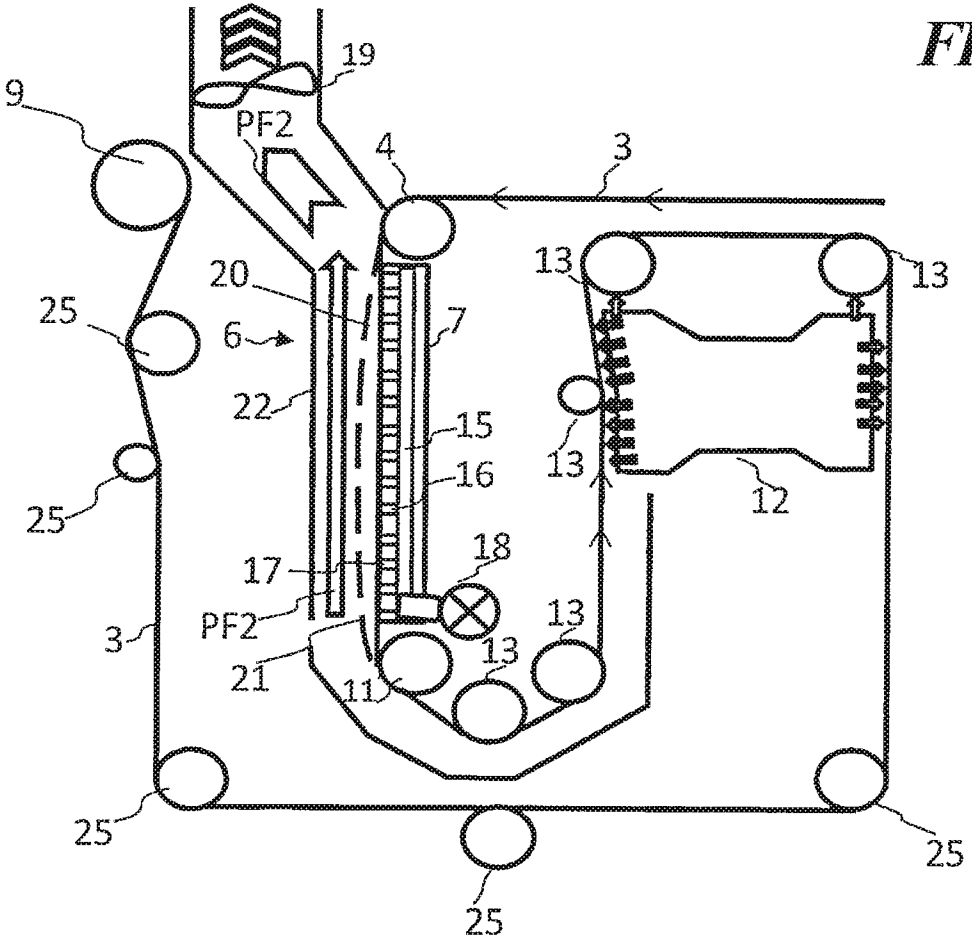
FIG. 2 is a design of a dryer with a heating saddle.

In order to optimally avoid the danger of a wave formation in the recording medium 3, the dryer 6 may be designed corresponding to FIG. 2. In addition to a drying channel 21 arranged at the heating saddle 7, the dryer 6 according to FIG. 2 also has a cooler 12 that is arranged after the heating saddle 7 and past which the recording medium 3 is directed (with the aid of rollers 13) for cooling.

According to an exemplary embodiment, the dryer 6 itself without cooler 12 comprises the following design:

- a heating saddle 7;
- a negative pressurer that may be partially integrated into the heating saddle 7 and that, for example, has a channel leading to the surface of said heating saddle 7, which channel provides a negative pressure channel 15, through-holes 16 and grooves 17;
- a negative pressurer 18 (a negative pressure blower, for example) at the intake of the negative pressure channel 15;
- an air exhaust (an air exhaust blower, for example) that discharges exhaust air from the dryer 6.

A channel 15, 16, 17 is thus integrated into the heating saddle 7, via which channel 15, 16, 17 a negative pressure may be exerted on the recording medium 3 in the direction of the heating saddle 7. This channel is formed from the grooves 17 on the surface of the heating saddle 7 in the direction of the recording medium 3, from the negative pressure channel 15 and from the through-holes 16 that connect the negative pressure channel 15 with the grooves 17. At the intake of the negative pressure channel 15, a negative pressure blower 18 is arranged as a negative pressurer. In the drying channel 21 (which is formed by a heating saddle door 22 and the heating saddle 7, for example), the recording medium 3 is directed past the heating saddle 7. Provided at the drying channel 21 is the air exhaust blower 19 via which the exhaust may be drawn out of the drying channel 21 by means of the generation of a negative pressure. For example, the air exhaust blower 19 may be arranged at the intake of the drying channel 21 (as viewed in the transport direction of the recording medium 3) in order to direct the exhaust out of the drying channel 21 in the direction of arrow PF2. The recording medium 3 is thus supplied via the roller 4 to the drying channel 21 and is conveyed out of the drying channel 21 via the roller 11. From the roller 11, the recording medium 3 is then directed via additional rollers 13 to the cooler 12 and from there is directed to the take-off roller 9 via rollers 25.

For drying, the recording medium 3 is then directed through the drying channel 21, past the heating saddle 7 (which is executed flat); the contact between the recording medium 3 and the heating saddle 7 is ensured via negative pressure via the channel 15, 16, 17, with the aid of the negative pressure blower 20. Without this negative pressure, the recording medium 3 could lift away from the heating saddle 7 due to the high exhaust flow in the drying channel 21 between the recording medium 3 and the heating saddle door 22. In printing operation, the negative pressure blower 18 is thus connected to the channel 15, 16, 17; the recording medium 3 is drawn by negative pressure to the surface of the heating saddle 7. At the same time, the air exhaust blower 19 may be activated in order to discharge the exhaust air in the drying channel. In printing operation, the air exhaust blower 19 thereby runs such that the drying process is not negatively affected given a recording medium 3 in the drying channel 21.

In order to avoid a wave formation in the recording medium 3, via targeted control of the negative pressure blower 18 and the air exhaust blower 19 the recording medium 3 is now raised from the heating saddle 7 immediately before a feed stop given a printing pause. The recording medium 3 remains in this raised state until the printing operation is resumed. Since the recording medium 3 no longer has contact with the heating saddle 7 in the standstill, the heat transfer is thus interrupted; markedly fewer waves can form in the recording medium 3. In order to achieve thus, at the beginning of the stop ramp the negative pressure blower 18 is deactivated and the air exhaust blower 25 is run up (in terms of its suction power in comparison to the printing operation) for a predetermined time. Due to the changing pressure relationships in the drying channel 21, the recording medium 3 raises from the heating saddle 7. The present path 20 of the recording medium 3 (depicted with a dashed line in FIG. 2) is maintained until the printing operation 3 is resumed (meaning that the movement of the recording medium 3 is restarted). The negative pressure blower 18 is then activated again and the air exhaust blower is set corresponding to the printing operation. The consequence is that the recording medium 3 is drawn again onto the heating saddle 7 and the air exhaust is conveyed out of the drying channel 21. The air exhaust blower 19 may be deactivated during the printing pause, after the recording medium 3 comes to a standstill.

In a method to operate ink printing apparatuses, the recording medium 3 is directed through the printer DE. The recording medium 3 is subsequently supplied to a dryer 6 having at least one heating saddle 7 and a drying channel 21 arranged at said heating saddle 7, in which dryer 6 the recording medium 3 is directed past the heating saddle 7. A negative pressure in the drying channel 21 is generated via an air exhaust 19 arranged at one end of said drying channel 21. In the printing operation, in the region of the heating saddle 7 a negative pressure is exerted—via a negative pressurer 15, 16, 17, 18—on the recording medium 3 in the direction of said heating saddle 7 so that this is then in contact with the recording medium 3 in order to dry the ink on said recording medium 3. Upon interruption of the printing operation with braking of the recording medium 3 in a stop ramp to a standstill, the negative pressure via the negative pressurer 15, 16, 17, 18 is deactivated at the beginning of the stop ramp, and the power of the air exhaust 19 is increased relative to printing operation so that the recording medium 3 is lifted from the heating saddle 7, and therefore the heat transfer from the heating saddle 7 to the recording medium 3 is interrupted. The recording medium 3 is thus no longer heated and does not dry out, or the danger of an overheating or burning of the recording medium 3 is minimized, as long as the recording medium 3 is stopped. The recording medium remains in this position until the printing operation is resumed.

REFERENCE LIST

DR ink printing apparatus
EG intake
AG receiver
PF direction
DE printer
1 print bar
2 print head
3 recording medium
4 take-off roller
5 guide roller
6 dryer
7 heating saddle
8 take-up roller
9 take-off roller
10 roller
11 roller
12 cooler
13 roller
15 negative pressure channel
16 through-hole
17 groove
18 negative pressurer
19 air exhaust
20 path of the recording medium in the drying channel
21 drying channel
22 heating saddle door
23 stack
24 stack
25 rollers Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. An ink printing apparatus, comprising:

a printer for printing to a recording medium;

a dryer arranged at an exit of the printer, said dryer having at least one heating saddle and a drying channel arranged at said heating saddle via which the recording medium is directed past the heating saddle;

said dryer having a negative pressurer in a region of the heating saddle, the negative pressurer being designed such that in a printing operation the pressurer exerts a negative pressure on the recording medium in a direction of the heating saddle such that the heating saddle is then in contact with the recording medium in order to dry the ink on said recording medium;

said dryer also having an air exhaust at one end of the drying channel, said air exhaust creating a negative pressure in the drying channel; and the negative pressurer deactivating the negative pressure at a beginning of a stop ramp during which the recording medium is brought to a standstill upon interruption of the printing operation with braking of the recording medium, and the air exhaust increases its power relative to a power of the air exhaust during printing operation after said interruption of the printing operation, so that a heat transfer from the heating saddle to the recording medium is interrupted.

2. The ink printing apparatus according to claim 1 in which the negative pressurer comprises a channel introduced into the heating saddle and a negative pressure source at an entrance of the channel.

3. The ink printing apparatus according to claim 2 in which the channel in the heating saddle has a negative pressure channel connected with the negative pressure source; through-holes connected with the negative pressure channel; and grooves leading to a surface of the heating saddle, said grooves being connected with the through-holes.

4. The ink printing apparatus according to claim 2 in which the negative pressure source comprises a negative pressure blower.

5. The ink printing apparatus according to claim 1 in which the air exhaust comprises an air exhaust blower.

6. The ink printing apparatus according to claim 5 in which the dryer deactivates the air exhaust blower when the recording medium has reached said standstill after said interruption of said printing operation.

7. The ink printing apparatus according to claim 5 in which the air exhaust blower is arranged at an entrance of the drying channel as viewed in a transport direction of the recording medium such that via the blower an air exhaust flow is drawn through the drying channel.

8. The ink printing apparatus according to claim 7 in which the drying channel is formed by the heating saddle and a side wall of the dryer.

9. A method to operate an ink printing apparatus, comprising the steps of:

directing a recording medium through a printer;

subsequently supplying the recording medium to a dryer having at least one heating saddle and a drying channel arranged at said heating saddle, and in the dryer, the recording medium being directed past the heating saddle;

generating a negative pressure in the drying channel via an air exhaust arranged at one end of said drying channel;

in the printing operation, with a negative pressurer exerting a negative pressure in a region of the heating saddle on the recording medium in a direction of said heating saddle so that the heating saddle is then in contact with the recording medium in order to dry the ink on said recording medium; and upon interruption of the printing operation with braking of the recording medium to a standstill in a stop ramp with the negative pressurer deactivating the negative pressure at a beginning of the stop ramp, and increasing a power of the air exhaust relative to a power for the printing operation after the interruption of the printing operation, so that heat transfer from the heating saddle to the recording medium is interrupted.

10. An ink printing apparatus, comprising:

a printer for printing to a recording medium;

a dryer arranged at an exit of the printer, said dryer having at least one heating saddle and a drying channel arranged at said heating saddle via which the recording medium is directed past the heating saddle;

said dryer having a negative pressurer in a region of the heating saddle, the negative pressurer being designed such that in a printing operation the pressurer exerts a negative pressure on the recording medium in a direction of the heating saddle such that the heating saddle is then in contact with the recording medium in order to dry the ink on said recording medium;

said dryer also having an air exhaust at one end of the drying channel, said air exhaust creating a negative pressure in the drying channel; and the negative pressurer deactivating the negative pressure substantially at a beginning of a stop ramp during which the recording medium is brought to a standstill upon interruption of the printing operation with braking of the recording medium so that a heat transfer from the heating saddle to the recording medium is interrupted.

11. A method to operate an ink printing apparatus, comprising the steps of:

directing a recording medium through a printer;

subsequently supplying the recording medium to a dryer having at least one heating saddle and a drying channel arranged at said heating saddle, and in the dryer, the recording medium being directed past the heating saddle;

generating a negative pressure in the drying channel via an air exhaust arranged at one end of said drying channel;

in the printing operation, exerting a negative pressure in a region of the heating saddle on the recording medium in a direction of said heating saddle so that the heating saddle is then in contact with the recording medium in order to dry the ink on said recording medium; and deactivating the negative pressure substantially at a beginning of a stop ramp during which the recording medium is brought to a standstill upon interruption of the printing operation with braking of the recording medium so that a heat transfer from the heating saddle to the recording medium is interrupted.

* * * * *